United States Patent [19]

Ichiryu et al.

[11] Patent Number: 4,529,362

[45] Date of Patent: Jul. 16, 1985

[54] SERVO PUMP FOR HYDRAULIC SYSTEMS

[75] Inventors: Ken Ichiryu; Haruo Watanabe; Tadahiko Nogami, all of Ibaraki, Japan

[73] Assignee: Hitachi, Ltd., Tokyo, Japan

[21] Appl. No.: 575,782

[22] Filed: Feb. 1, 1984

[30] Foreign Application Priority Data

Feb. 7, 1983 [JP] Japan ..... 58-17312
Nov. 9, 1983 [JP] Japan ..... 58-209044

[51] Int. Cl.[3] ..... F04B 17/00; F04B 1/20

[52] U.S. Cl. ..... 417/271; 417/372

[58] Field of Search ..... 417/269, 271, 366, 372, 417/419, 206; 91/499, 485

[56] References Cited

U.S. PATENT DOCUMENTS

| | | | |
|---|---|---|---|
| 1,819,966 | 8/1931 | Olson | 417/269 |
| 2,620,736 | 12/1952 | Overbeke | 91/485 |
| 2,780,170 | 2/1957 | Stoyke et al. | 417/206 |
| 2,942,555 | 6/1960 | Pezzillo | 417/366 |
| 3,085,514 | 4/1963 | Budzich | 417/269 |
| 3,627,451 | 12/1971 | Kouns | 417/271 |
| 3,672,793 | 6/1972 | Yowell | 417/271 |
| 4,014,628 | 3/1977 | Rusoff | 91/499 |

FOREIGN PATENT DOCUMENTS

| | | | |
|---|---|---|---|
| 667359 | 3/1937 | Fed. Rep. of Germany | 417/271 |
| 2264610 | 5/1974 | Fed. Rep. of Germany | 91/499 |
| 1195324 | 11/1959 | France | 417/271 |
| 614701 | 6/1961 | Italy | 417/419 |
| 1213664 | 11/1970 | United Kingdom | 417/269 |
| 2054750 | 11/1981 | United Kingdom | 91/499 |

*Primary Examiner*—William L. Freeh
*Attorney, Agent, or Firm*—Antonelli, Terry & Wands

[57] ABSTRACT

A servo pump for use in a hydraulic system. The servo pump is constituted by a variable displacement type hydraulic pump adapted to be driven by a high-speed motor and to hydraulically drive an actuator. The motor and the pump are housed in a common casing. The motor shaft and the pump shaft are integrated to form a common rotary shaft which is supported rotatably at both its ends by end bearings and at its intermediate portion by an intermediate bearing.

2 Claims, 4 Drawing Figures

SERVO PUMP FOR HYDRAULIC SYSTEMS

BACKGROUND OF THE INVENTION

The present invention relates to a servo pump suitable for use in machineries such as industrial robots, vibration beds and so forth.

To cope with the current demand for energy conservation, hydraulic systems having a variable-displacement type pump, referred to as a "servo pump," are becoming popular. In these systems the servo pump is used as a driving source for driving an actuator such as a hydraulic cylinder, hydraulic motor or the like. It is also preferred in these known hydraulic systems that the servo pump is situated as closely as possible to the actuator, in order to eliminate unfavourable effect which may be incurred through the piping system which interconnects the servo pump and the actuator.

In the conventional hydraulic systems, however, it is difficult to position the servo pump closely to the actuator, mainly because the size of the servo pump itself is to large.

Under this circumstance, attempts have been made to reduce the sizes of the pump and motor to realize a compact construction of the servo pump as a whole. As a matter of fact, however, there still is a practical limit in the reduction of the size and weight of the servo pump due to structural reasons.

SUMMARY OF THE INVENTION

Accordingly, an object of the invention is to provide a servo pump in which a motor and a pump are united through a rotary shaft so that the axial length of the rotary shaft is reduced and the size and weight of the servo pump as a whole are decreased.

Another object of the invention is to provide an improved servo pump wherein the loss of energy caused by the rotation of the rotor of the motor is reduced.

To these ends, according to an aspect of the invention, there is provided an improved servo pump for use in a hydraulic system and constituted by a variable-displacement type hydraulic pump adapted to be driven by a high-speed motor and to hydraulically drive an actuator, wherein the motor and the pump are housed in a common casing and the motor shaft and the pump shaft are united to form a common rotary shaft which is supported at both its ends by end bearings and at its intermediate portion by an intermediate bearing.

Other objects, features and advantages of the invention will become clear from the following description of the preferred embodiments taken in conjunction with the accompanying drawings.

DESCRIPTION OF THE PREFERRED EMBODIMENTS

Figure 1:
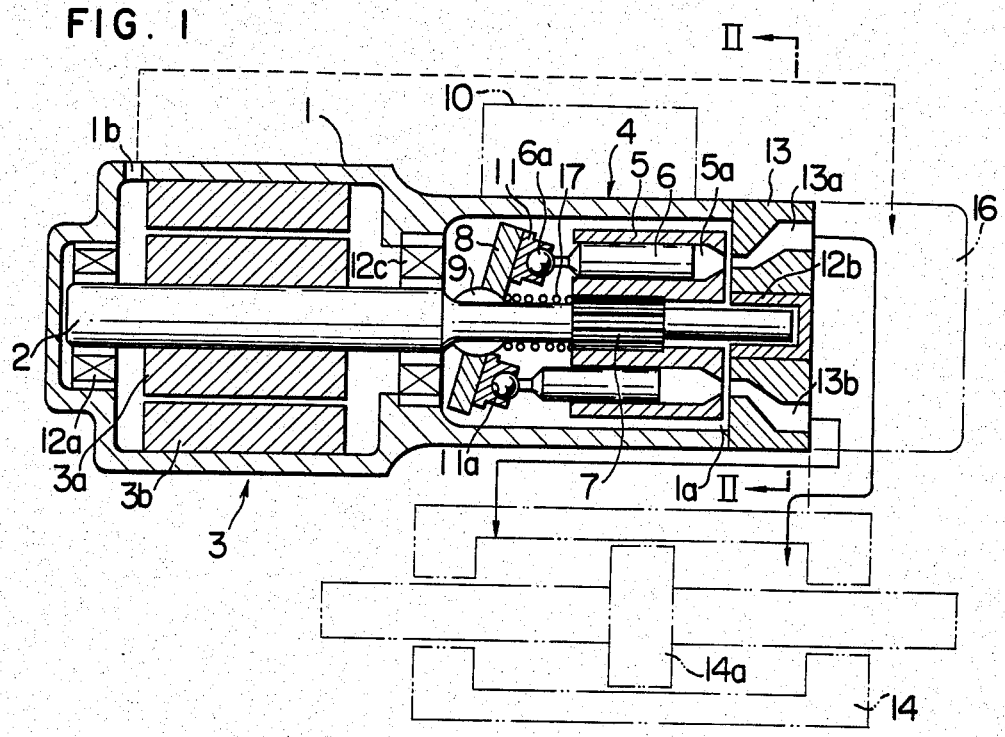
FIG. 1 is a sectional view showing an embodiment of the servo motor in accordance with the invention.
Figure 2:
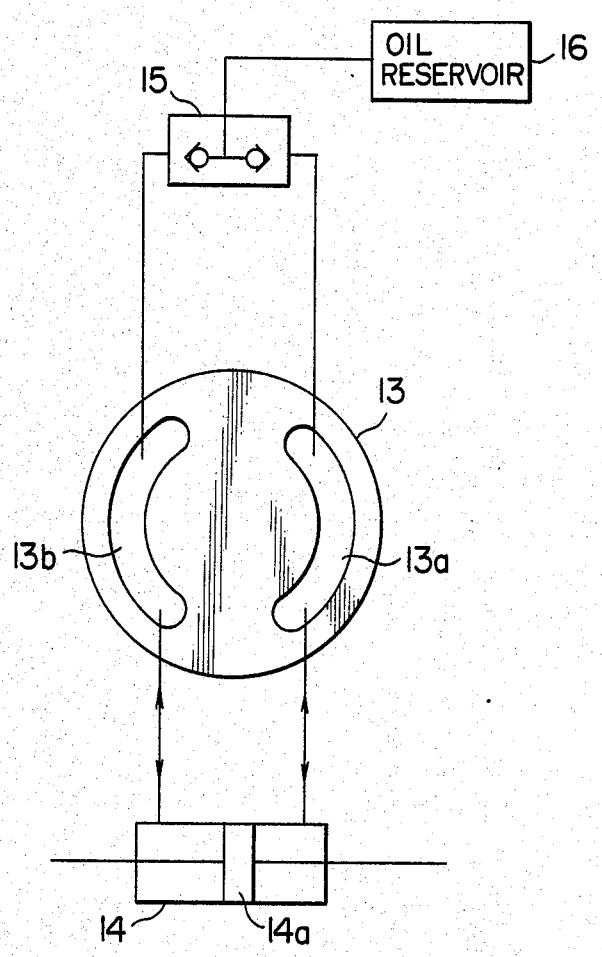
FIG. 2 is a sectional view taken along the line II—II of FIG. 1.

Referring now to the drawings, and particularly to FIGS. 1 and 2, it is seen that a servo pump according to the invention has a casing 1 opened at its one end 1*a*

(right side as viewed in FIG. 1) and provided with an oil port 1*b*. The casing 1 accomodates a high-frequency motor 3 and a variable-displacement type hydraulic pump 4 which are united through a rotary shaft 2. The motor 3 is mainly composed of a rotor 3*a* attached to the rotary shaft 2 and a stator 3*b* secured to the inner surface of the casing 1. The main body of the hydraulic pump 4 has a cylinder block 5 meshing with a spline 7 formed in the outer peripheral surface of the rotary shaft 2 for rotation together with the latter and provided with a plurality of cylinder bores 5*a*, pistons 6 slidably received by respective cylinder bores 5*a* and provided at their ends with spherical portions 6*a*, and so forth. A reference numeral 8 designates a shoe plate which is adapted to be tilted by means of a control valve 10 while being guided along a guide 9 attached to the rotary shaft 2. A piston shoe 11 provided with an annular groove 11*a* is fixed to the shoe plate 8. The annular groove 11*a* slidably receives the spherical portions 6*a* of the pistons 6.

The rotary shaft 2 is rotatably supported at both its ends by end bearings 12*a* and 12*b* and at its mid portion by an intermediate bearing 12*c* mounted on the inner wall of the casing 1 formed between the motor 3 and the hydraulic pump 4. An end plate 13 covering the open end 1*a* of the casing 1 holds the end bearing 12*b*. The end plate 13 is provided with arcuate oil ports 13*a* and 13*b* for sucking and discharging the working oil. These arcuate oil ports 13*a* and 13*b* open at their one ends to the cylinder block 5 and are communicated at their other ends with an actuator 14 having a piston 14*a*. The other ends of the oil ports 13*a* and 13*b* also communicated with an oil reservoir 16 through a shuttle valve 15. In order to eliminate any gap which may be formed between the cylinder block 5 and the end plate 13, a resilient pressing force is applied to the cylinder block 5 by a spring 17 acting between the guide 9 and the cylinder block 5.

The described embodiment of the servo pump of the invention operates in a manner explained hereinunder.

First of all, the shoe plate 8 and the piston shoe 11 are inclined to the right side as illustrated in FIG. 1 by a control valve 10. As the rotary shaft 2 is rotated by a high-frequency motor 3 in this state, the cylinder block 5 is rotatingly driven by the rotary shaft 2 through the spline 7, so that the pistons 6 in the cylinder bores 5*a* of the cylinder block 5 are rotated together with the latter. Since the spherical ends 6*a* of the pistons 6 slide along the annular groove 11*a* in the piston shoe 11, the pistons 6 move to the left and right repeatedly in each 180° rotation of the shoe plate 8. Consequently, the working oil sucked into the cylinder bores 5*a* of the cylinder block 5 through the shuttle valve 15 is forced into the chamber defined at the right side of the piston 14*a* in the actuator 14 through the oil port 13*a*, thereby to displace the piston 14*a* to the left. As a result, the oil in the chamber defined at the left side of the piston 14 is returned to the oil reservoir 16 through the oil port 13*b* in the end plate 13 and through the shuttle valve 15. The operation is reversed if the piston shoe plate 8 is inclined in the opposite direction to that shown in FIG. 1.

On the other hand, the drain of oil leaked from the oil pump 4 flows across the intermediate bearing 12*c* into the chamber accomodating the motor 3 to effectively cool the motor 3. The oil is then returned to the oil reservoir 16 through the oil port 1*b* formed in the casing 1. Since the motor 3 is effectively cooled by the drain oil, it is possible to reduce the size of the motor 3 by increasing the magnetic and electric loadings of the motor 3. Furthermore, since this arrangement does not necessitate any oiltight seal, it is possible to reduce the loss of energy produced when the shaft is rotated.

In the described embodiment, the motor and the pump are integrated through a common rotary shaft which is supported at three points along the length thereof. This arrangement offers the following advantages.

(1) The axial length of the rotary shaft can be reduced considerably.

(2) The loss of energy due to friction in the bearings can be diminished because the motor shaft end adjacent to the pump and the pump shaft end adjacent to the motor can be supported by a common bearing.

(3) The loss of energy is decreased through the elimination of a mechanical seal or an oil seal which is required for effecting a seal of the motor in the conventional servo pump.

(4) The cooling of the motor by oil is facilitated.

Figure 3:
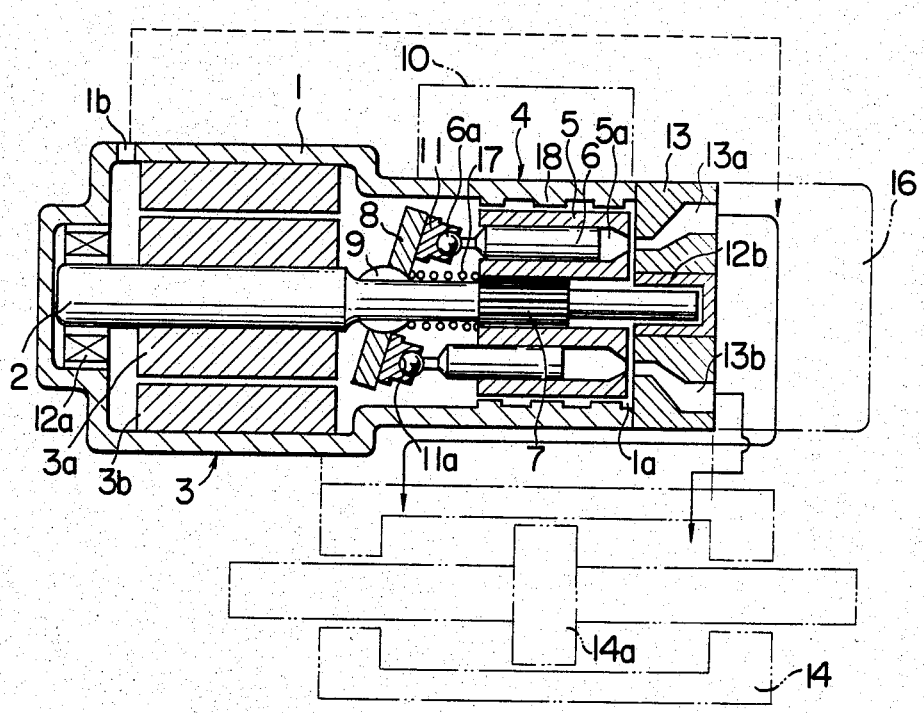
FIG. 3 is a sectional view of another embodiment of the servo pump in accordance with the invention.

FIG. 3 shows another embodiment of the invention in which the same reference numerals denote the same parts or members as those used in FIG. 1.

In the embodiment shown in FIG. 3, unlike the embodiment shown in FIG. 1 having an intermediate bearing 12*c* provided on the inner wall of the casing 1 between the motor 3 and the pump 4, an intermediate bearing 18 is provided on the inner peripheral surface of the portion of the casing 1 opposed to the outer periphery of the cylinder block 5. By supporting the cylinder block 5 by the intermediate bearing 18 in the illustrated manner, it is possible to further reduce the length of the rotary shaft 2 which in turn contributes to a further reduction in the size of the servo pump as a whole.

Still another embodiment of the invention will now be described with specific reference to FIG. 4 in which the same reference numerals are used to denote the same parts or members as those used in FIGS. 1 and 3. A reference numeral 19 designates a hollow drive shaft which rotates as a unit with the rotor 3*a* of the high-frequency motor 3. The drive shaft 19 is supported at both its ends by bearings 12*a* and 12*c*. A spline 19*a* is formed in the inner peripheral surface of the drive shaft at the right side end of the latter as viewed in FIG. 4. A reference numeral 20 denotes a driven shaft which is connected at its one end to the hollow drive shaft 19 through the spline 19*a*. The driven shaft 20 is integrally connected at its other end to the cylinder block 5 of the pump 4 through the spline 7. A compression spring 21 is loaded between the end surface of the driven shaft 20 received by the hollow of the drive shaft 19 and a spring seat 22. This compression spring 21 imparts a moderate resilient force to the cylinder block 5 in order to eliminate any gap between the cylinder block 5 and the valve plate 13. A reference numeral 23 designates a collar, while 24 denotes a bearing having an inner peripheral surface fitting on the outer peripheral surface of the cylinder block 5. In this embodiment, the drain oil from the motor 3 is returned to the oil reservoir across the bearing 12*c* or through another oil passage (not shown), past the port 1*b*. Therefore, no sealing mechanism is provided between the pump and the motor. In this embodiment, a boost pump 25 is disposed in the valve plate 13. The boost pump 25 is driven through a spline shaft 26 as in the case of the driving of the cylinder block 5 by the drive shaft 19. The boost pump 25 sucks the oil from the oil reservoir 16 and discharges the same at a suitable pressure. The discharged oil is introduced through the shuttle valve 15 so as to flow along the same passage as the oil returned from the actuator 14, and flows into either one of the oil ports 13*a* and 13*b* in the valve plate 13. On the other hand, the pressurized oil from the discharging oil port in the valve plate 13 flows into one of the chambers in the actuator 14, so that the position of the piston 14*a* in the actuator 14 is controlled.

Figure 4:
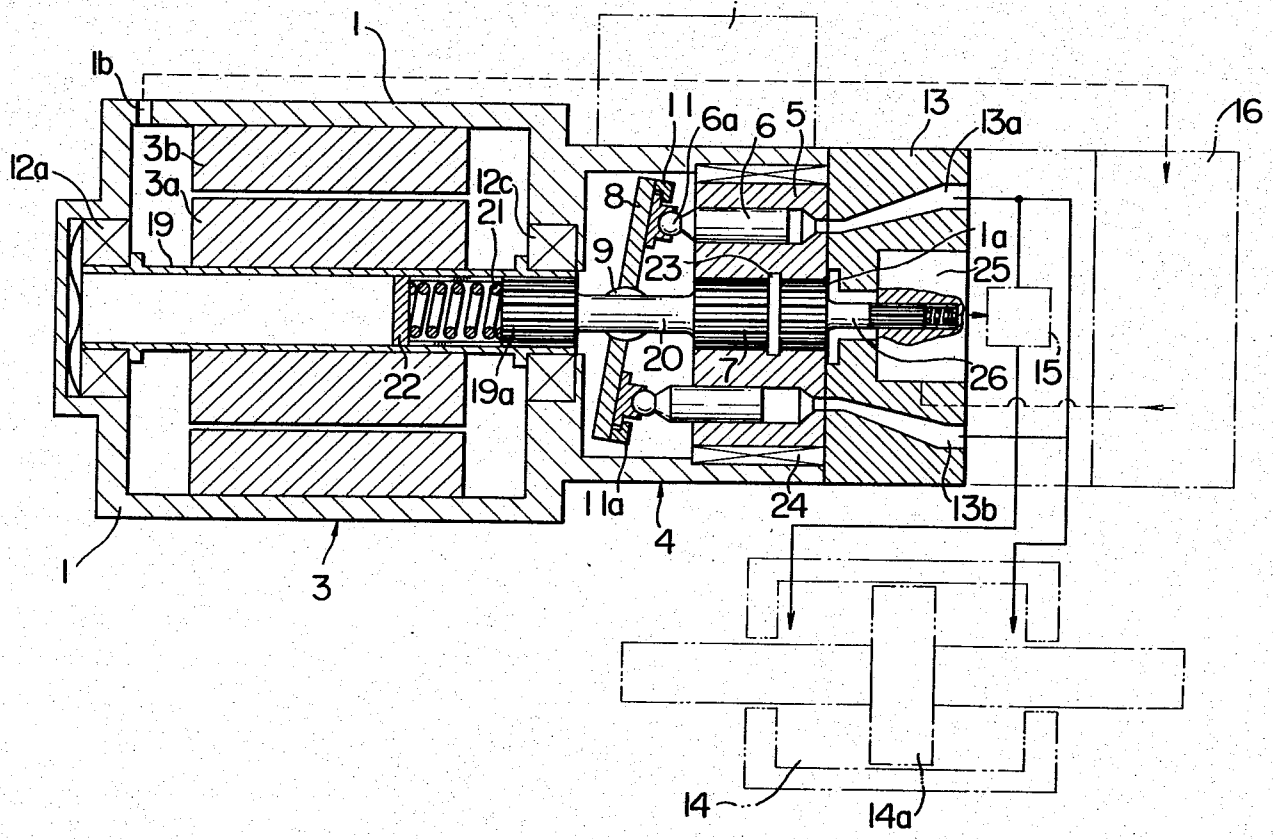
FIG. 4 is a sectional view of still another embodiment of the servo pump in accordance with the invention.

Thus, in the embodiment shown in FIG. 4, the length of the driven shaft 20 is further reduced owing to the arrangement in which the spring 21, which is usually disposed on the pump body, is housed by the hollow of the drive shaft 19 carrying the rotor of the motor. Consequently, the size and weight of the servo pump as a whole can be further decreased.

As has been described, according to the invention, the motor and the pump are united through a rotary shaft so that the axial length of the unit including the motor and the pump can be decreased advantageously. In addition, the size and weight of the servo pump as a whole are decreased because the number of the bearings supporting the motor and the pump can be minimized.

What is claimed is:

1. A servo pump for use in a hydraulic system and constituted by a variable displacement type hydraulic pump adapted to be driven by a high-speed motor and to hydraulically drive an actuator, an improvement which comprises that said motor and said pump are housed in a common casing and that a motor shaft and a pump shaft are united to form a common rotary shaft which is rotatably supported at its both ends by end bearings and at its intermediate portion by an intermediate bearing, wherein one of said end bearings is provided on a portion of an inner peripheral surface of said casing opposed to the outer peripheral surface of a rotor of said pump, and wherein said motor shaft is partially hollowed and said pump shaft is integrated with said motor shaft by being splined to the hollow of said motor shaft, said pump shaft being biased by a spring loaded between the bottom of the hollow of said motor shaft and the end surface of said pump shaft so that a cylinder block of said pump is resiliently pressed against a valve plate.

2. A servo pump according to claim 1, wherein means are provided for introducing the drain oil of said pump to said motor thereby to cool said motor by said drain oil.

* * * * *